United States Patent [19]

Jones

[11] Patent Number: 4,574,590

[45] **Date of Patent: * Mar. 11, 1986**

[54] HIGH TEMPERATURE ENGINE AND SEAL

[76] Inventor: Dedger Jones, 885 Freeway Dr. North, Columbus, Ohio 43229

[ * ] Notice: The portion of the term of this patent subsequent to Dec. 4, 2001 has been disclaimed.

[21] Appl. No.: 648,580

[22] Filed: Sep. 10, 1984

Related U.S. Application Data

[63] Continuation-in-part of Ser. No. 447,267, Dec. 6, 1982, Pat. No. 4,485,628.

[51] Int. Cl.[4] ..... F01K 13/00

[52] U.S. Cl. ..... 60/676; 60/650; 92/168; 277/22

[58] Field of Search ..... 92/168 R, 109, 208; 277/22, 26; 123/193 CP; 60/650, 676, 682

[56] References Cited

U.S. PATENT DOCUMENTS

| | | | |
|---|---|---|---|
| 945,233 | 1/1910 | Hatch | 92/168 X |
| 2,157,229 | 5/1939 | Bush | 60/517 X |
| 4,120,161 | 10/1978 | Gedeit | 60/682 |
| 4,179,893 | 12/1979 | O'Hare | 60/682 |
| 4,345,768 | 8/1982 | Roussin | 277/22 |
| 4,485,628 | 12/1984 | Jones | 60/650 |

*Primary Examiner*—Stephen F. Husar
*Attorney, Agent, or Firm*—John L. Shailer

[57] ABSTRACT

A method and apparatus for better sealing a piston to its cylinder, to effectively eliminate efficiency loss due to leakage of the high-temperature, high pressure driving gas around the edges of the piston. An elastomeric seal is located so as to seal the piston and cylinder combination at a minimum sufficient distance from the combustion chamber to prevent heat damage to the seal material by conduction of heat through the piston or cylinder material.

18 Claims, 5 Drawing Figures

FIG. 1
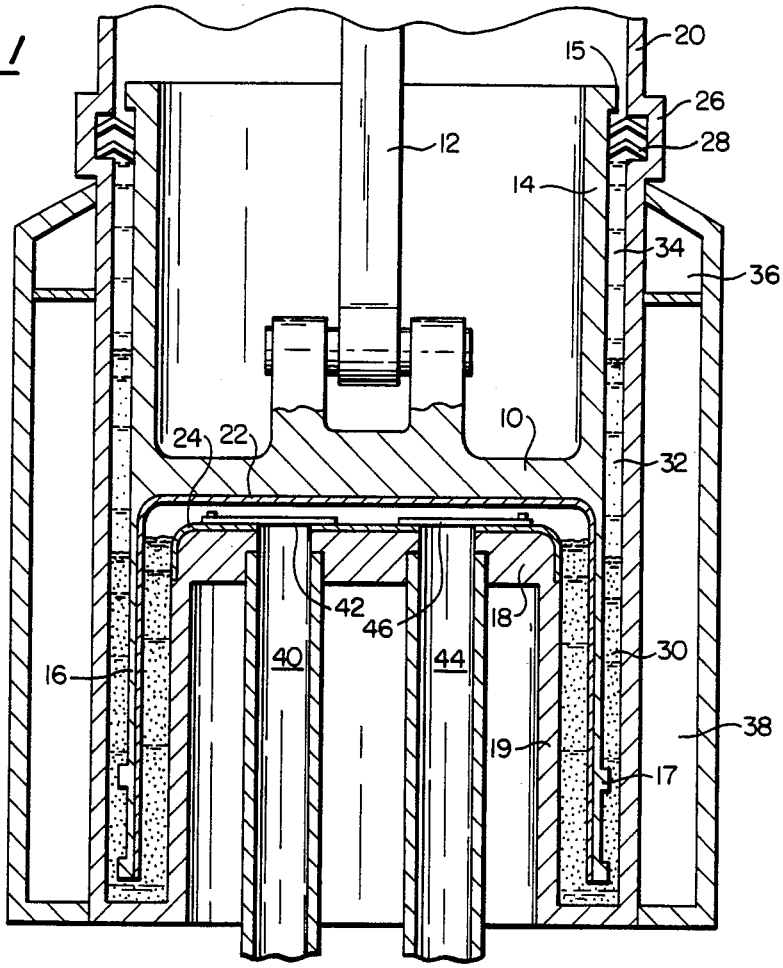
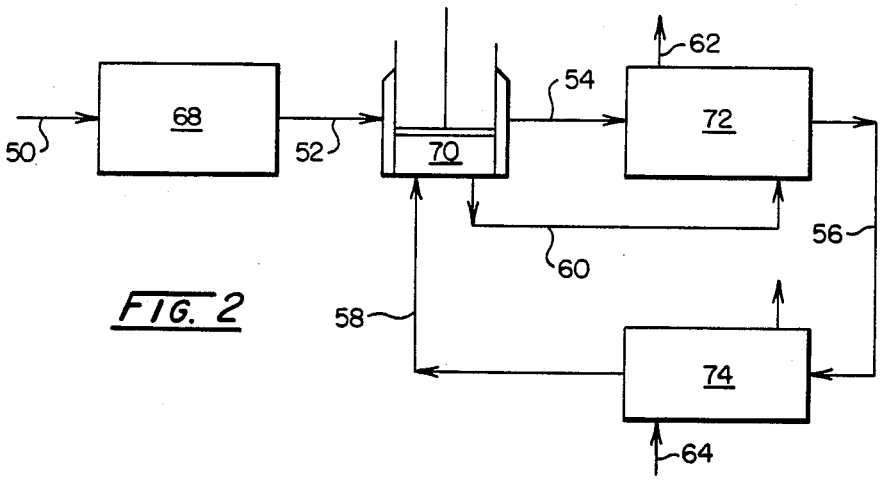
FIG. 2

HIGH TEMPERATURE ENGINE AND SEAL

FIELD OF THE INVENTION

The present application is a continuation-in-part of U.S. patent application, Ser. No. 447,267, filed on Dec. 6, 1982, now U.S. Pat. No. 4,485,628, which is incorporated herein by reference thereto.

The invention relates to a method and apparatus for sealing a piston to a cylinder in a piston engine apparatus. The invention more particularly relates to a method of sealing such a piston and cylinder combination using relatively low-temperature rated pressure seals yet operating the cylinder and piston combination at relatively higher temperatures than the rating values of the seals. The invention also relates to a high-temperature heat engine utilizing such a seal and also to a highly efficient heat engine operating at very high temperatures.

BACKGROUND OF THE INVENTION

The problems of sealing the moving parts of an energy-producing device are well known. Indeed the problems of sealing a piston and cylinder combination have been so severe in the past that the problem has led to the development of alternative devices for extracting energy, these alternative devices then having a different type of sealing apparatus as for example of the centrifugal type or other type to avoid the problems of pressure sealing a sliding motion of a piston within a cylinder. The standard method for sealing a cylinder and piston combination is with oil rings which are discontinuous rings of metal located in the piston wall that slideably engage the interior surface of the cylinder. The quantity and tolerances of construction of these oil rings produces a reasonably leak-tight piston-to-cylinder combination for many general purposes and this device combination is well-known in automobile engines, air compressors and other piston driven apparatus. However, despite the presence of a tortuous or labyrinthine type of path, leakage in fact does occur. The problem is that this leakage reduces power, because at peak pressure some of the driving gas is bled off past the seals. Additionally, abrasive contaminants and pollutants may pass the seals and cause abrasion at the seals and of the cylinder wall. Such contaminating materials may also contaminate the oil in the crank case area below the pistons, leading to abrasion of other moving parts. The production and presence of pollutants and abrasives severely decreases the life of the seals of a cylinder and the piston combination. Additionally, the friction of a plurality of oil rings against the cylinder wall tends to reduce the power available.

The problems of pollutants, leakage and abrasives are even more aggravated when higher temperature conditions are attempted within the piston-cylinder combination. Most seals of the elastomeric type have maximum temperature rating in the 500°-600° F. (260°-315° C.) range although some modern seals actually have temperature ratings as high as 900° F. (482° C.). Both of these problems, temperature and pollution abrasion are discussed in U.S. Pat. No. 4,120,161 to Gedeit when he states that he strives to keep the operating temperatures to a maximum of 800° F. (425° C.) and also attempts to segregate combustion gases, which also contain pollutants and abrasives, away from the piston and cylinder power generating train, to protect the pistons and lubricating oils from the carbon deposits, corroding chemical residue and abrasive grit that would be leaking past any seals. In addition to reducing the life of the seals, pistons and cylinders, there are the maintenance considerations and "down-time" requirements simply to replace worn or deteriorating seals on a periodic basis. Such a maintenance time period becoming shorter and shorter or occurring more often as the temperatures increase.

The entire situation is aggravated because engine efficiency is known to be at its greatest when the engine operating temperatures are at the highest possible levels. The Carnot engine is the theoretical embodiment of the perfect heat engine. The Carnot cycle comprises a four-step cycle beginning with an isothermic expansion followed by an adiabatic expansion, these in turn being followed in order by an isothermic compression and an adiabatic compression. If all of these steps are done in a thermodynamically reversible way, the result is a rectangular plot on a temperature-entropy diagram which is known as a standard way of expressing such a thermodynamic cycle. Most attempts to produce a more efficient engine have centered upon attempts to approximate a Carnot type of cycle. Carnot efficiency is expressed as the difference in the enthalpies represented by the two adiabatic portions of the cycle divided by the enthalpy of the fluid during its adiabatic expansion. In the thermodynamically reversible Carnot cycle this can be further simplified to be the difference between the temperature of the working fluid in the engine and the temperature of the heat sink divided by the temperature of the working fluid in the engine. Therefore it can be seen that the greater the difference between the heat sink temperature and the cylinder operating temperature, the higher the efficiency of the engine. Heretofore, efficiencies based upon increasing the temperature at which the cylinder operates have been limited by the maximum temperatures not of the metals but of the sealing materials. As the temperature increased the efficiency losses due to loss of compression by leakage past deteriorating or inherently leaking seals was the limiting factor.

Therefore, there is a need for an apparatus for sealing a high temperature engine piston and cylinder combination using conventional and readily obtainable seal materials. There is also a need to improve the design of pistion and cylinder combinations to allow the use of conventional and readily obtainable materials to be used in the construction.

SUMMARY OF THE INVENTION

Therefore a primary aspect of the present invention resides in the provision of a relatively low temperature rated seal located in the cylinder wall at a distance away from the cylinder head of at least the maximum piston stroke length.

Another aspect of the present invention lies in the provision of an intermediary fluid between the high temperature working fluid of the cylinder piston area and the seal.

A further aspect of the invention resides in the selection of suitable fluids to serve as the intermediary fluid described above.

Another aspect of the present invention resides in the provision of a heat engine cycle wherein the engine is of the piston-cylinder type sealed with such a sealing apparatus.

A further aspect of the present invention resides in the provision of a very efficient high-temperature engine cycle.

Another aspect of the present invention resides in the provision for manufacturing a cylinder-piston sealed combination relatively inexpensively with a minimum of machining or material surface preparation. Such a construction would inherently be less expensive to manufacture thus bring such high-efficiency technology within the reach of even developing nations at a very reasonable cost.

Another primary aspect of the present invention is the provision of a pressure seal spaced apart from the face end of a piston sufficiently far so as to prevent heat at the surface of the piston face end from being excessively transferred by conduction to the seal.

A further aspect of the present invention lies in the provision of an improved heat sink at the closed end of the cylinder in a piston and cylinder combination.

BRIEF DESCRIPTION OF THE DRAWINGS

The best mode contemplated in carrying out this invention is illustrated and better understood by reference to the following detailed description when considered in conjunction with the accompanying drawings, in which:

FIG. 1 is a cross-sectional elevational view of a piston and cylinder showing a seal structure according to the present invention.

FIG. 2 is a block diagram depicting the cycle for a thermodynamic heat engine according to the present invention.

DETAILED DESCRIPTION OF THE PREFERRED EMBODIMENTS

SEAL

Figure 3:
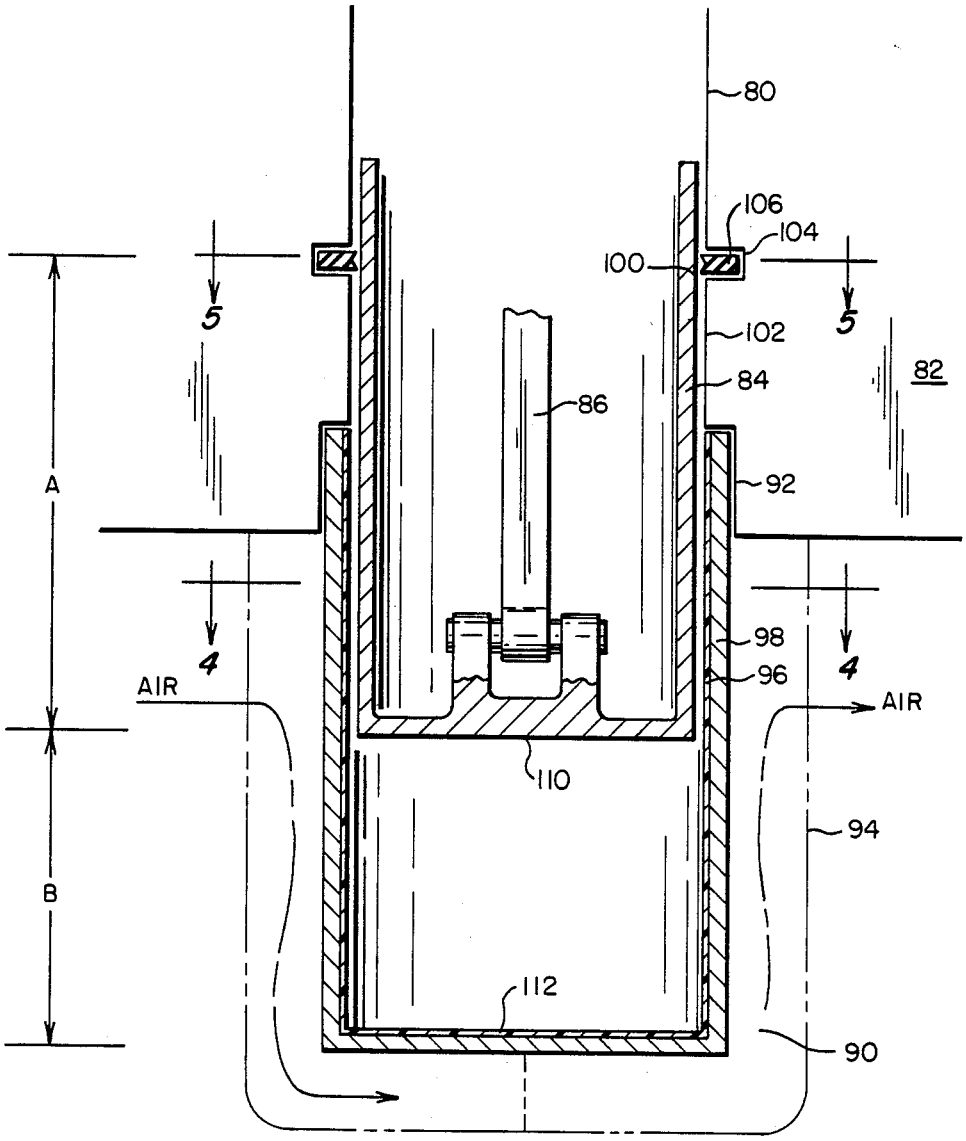
FIG. 3 is a cutaway elevational view of a cylinder and piston combination with elastomeric seal and heat sink according to the present invention.

Heretofore the elements for providing a seal between a piston and a cylinder for retaining the pressure that resides in the cavity between the piston head and the cylinder head have been placed in the piston body, as for example "oil rings". The present invention inolves a sealing apparatus where the seals are located in the cylinder wall. Such an embodiment is shown in FIG. 1 where piston head 10 is connected to a piston rod or connecting rod 12 and said rod 23 is connected to a fluid cylinder or a crank shaft of some sort for transmission of power. The crankshaft is not shown in FIG. 1. The piston head 10 is shown in close proximity to cylinder head 18 and is shown residing near the cylinder wall 20. The piston has an upper skirt extension 14 which lies in the direction away from the cylinder head and toward the rod end of the piston. This upper skirt assembly 14 is located on the perimeter of the piston 10. Standard commercially available pistons with rings also have such a skirt extension in order to provide a place for the oil rings to be located. If oil rings are not present, such a skirt extension would not ordinarily be necessary, however, in the present embodiment upper skirt extension 14 is required since the seals 28 ride against the machined outer surface of upper extension 14.

The piston also has a lower skirt extension 16 which also resides at the perimeter of the piston head 10 and extends downward in a direction into or toward the cylinder head 18. A cavity or reservoir 19 has been formed in the head of the cylinder around the perimeter of the cylinder head 18 sufficient to receive the lower skirt extension 16 and also to retain a sealing fluid 30 which is more fully described below. The reservoir or groove 19 is sufficiently deep to provide clearance at its bottom so that the lower skirt extension 16 does not touch the bottom and the fluids 30 can fully communicate around the end of skirt extension 16. Due to the very high-temperature nature of the engine according to the present invention, insulation 22 is provided on the face of the piston 10 and additional insulation 24 is provided on the cylinder head. This insulation is preferably of the ceramic type capable of sustaining temperatures in excess of 2,000° F. (1093° C.) thereby protecting the metallic portions of the piston 10 and the cylinder head 18. The insulation 22 on the piston also extends own the inside surface of lower skirt extension 16. A seal preferably of the elastomeric variety with a preferred temperature rating of approximately 900° F. (482° C.) is retained in a retainer 26 located within cylinder wall 20. The retainer 26 holds the seal material 28 in contact with upper skirt extension 14 providing a tight pressure seal to retain the pressure present between the piston head 10 and the cylinder head 18 within that area preventing it from leaking past.

Fluid 30 discussed above is preferably liquid Gallium or other liquid metal having a liquid range from low temperatures to in excess of cylinder operating temperatures. Gallium has a melting point of 86° F. (29.8°0 D.) and a boiling point of 3,600° F. (1983° C.) which fully covers the range from ambient or "cold" starting conditions to full temperature operation well in excess of 2,000° F. (1093° C.). Other possible metals would be sodium, mercury and tin although sodium has reactivity problems which are well known in the art; mercury may form a bulky emulsion with oils, although this emulsion breaks up upon heating; and tin has a rather high melting point creating problems during start-up. FIG. 1 also shows the presence of a second liquid 32 which floats on top of the liquid Gallium or other liquid metal 30, this liquid 32 is preferably a liquid salt as for example a low temperature drawiung salt as manufactured by Park Chemical Co. or equal having a melting point of 275° F. (135° C.) and a maximum working temperature of 1100° F. (593° C.). This salt is an eutectic mixture of nitrate and nitrite salts. This liquid is immiscible in liquid 30 and is also immiscible in liquid 34 which is a high temperature heat transfer oil as for example Dowtherm (a product of Dow Chemical Co.) or other equivalent heat transfer oil that is not miscible in the other two liquids.

Also shown in FIG. 1 is a heat transfer jacket 36 which is an air cooled heat exchanger wrapped around the outside of the cylinder in the area immediately adjacent to the seal 26 area. The purpose of heat transfer jacket 36 is to remove excess heat to maintain the temperature of the heat transfer oil or liquid metal that resides in that zone between the cylinder wall 20 and the upper skirt extension 14 at a temperature below the temperature rating of the seal 28. Also shown in a second heat transfer jacket 38 which encircles the cylinder and acts as a preheater for compressed gas that will eventually b e charged into the engine 70, as is more fully described below. Also shown in FIG. 1 are inlet ports 40 with its associated inlet valve 42 and exhaust port 44 with its associated exhaust valve 46.

By closely observing FIG. 1, it will be noted that the only areas requiring detail machining are the areas of upper skirt extension 14 which will come in direct contact with seals 28. All other areas are devoid of metal-to-metal contact. Only a moderately finished surface is required for the interior of cylinder wall 20 in order to accommodate the top piston guide 15 and also to accommodate the guide bumps 17 on the exterior of the lower skirt extension 16. The guides 15 and 17 are solely for the purpose of guiding the piston smoothly in a parallel direction within cylinder wall 20. Liquid metal to solid metal contact does not require a fine-machined surface. A rough finishing surface as in a rough cast surface will be sufficient. Because of the relative thinness of the layer of liquid metal 30 residing between cylinder wall 20 and the exterior surfaces of upper skirt extension 14 and lower skirt extension 16 there is little or no axial mixing. For this reason, there is very moderate amount of heat transfer by other than direct conduction in the liquids 30, 32 and 34. Also the liquid film acts as a lubricant reducing piston to cylinder friction.

It will be appreciated that all three liquids described in FIG. 1 the liquid metal 30, the liquid salt 32 and the oil 34 need not be present in any specific embodiment. The only fluid required may in fact be the liquid metal which is essentially non-volatile, the liquid salt may act alone since it is also non-volatile or any combination of liquids having the above attribute of non-volatility and mutual immiscibility would serve the purpose if the temperature ranges available were appropriate.

HIGH TEMPERATURE HEAT ENGINE

Turning now to FIG. 2 which shows a block diagram of a heat energy eycle according to the present invention. The cycle depicted in an upon cycle receiving working fluid, preferably air entering a compressor 68 via line 50, the output of compressor 68 is compressed airline 52 which delivers the compressed working fluid to a heat exchange jacket surrounding the cylinder 70 of the actual engine. The working fluid absorbs more heat from the very hot jacket area of the cylinder and proceeds to economizer 72 via line 54. The thermodynamic process occurring at the cylinder 70 is a constant volume temperature increase which produces a corresponding pressure increase. The economizer 72 is a counterflow heat exchanger with the working fluid entering via line 54 and being heated by a constant volume process in the heat exchanger receiving heat from the exhaust gases coming from the engine 70 via line 60, those gases then exiting the economizer via line 62 returning the working fluid back to the original pressure at which it was received at line 50. The further heated working fluid moves via line 56 to a secondary heat exchanger heat is input from any other heating process be it from the burning of a conventional fossile fuel or a counterflow heating by a fluid that has been heated in a solar energy cycle. The heating occuring in secondary heat exchanger 74 is again of the constant volume type. Appropriate valves are present in all lines, not shown, to prevent backflow and backpressure; also, appropriate reservoir volumes may be required in order to smooth out the flow. These reservoirs are also not shown. The heated pressurized working fluid then enters the inlet port of the engine via line 58. The inlet port for line 58 was shown on FIG. 1 as item 40 and the exhaust port for line 60 was shown as item 44.

The compressor 68 is primarily an adiabatic pressure process. There is no inter-cooling since obtaining the highest possible temperatures is the purpose of this heat engine process.

In a typical heat engine cycle according to the present invention, air at one atmosphere and ambient temperature drawn via line 50 into compressor 68 and pressurized to approximately 60 psig. (4 bar) and its corresponding temperature of approximately 500° F. (260° C.) at the temperature of the working fluid is then increased from approximately 500° F. 8260° C.) to an excess of 2,000° F. (1093° C.) via the constant volume energy input an engine 70 in the jacket at the economizer 72 and at the secondary heat exchanger 74 yielding a working fluid entering the engine 70 via line 58 with the condition 250 psig (16 bar) and in excess of 2,000° F. (1093° C.).

The expansion in engine 70 is primarily a near-isobaric process pushing the piston in the cylinder to extract energy in a crankshaft or in some other fluid via a piston rod or other appropriate energy extraction/conversion device. Thus, the thermal energy in the cycle is converted to mechanical energy. It will be appreciated that during the expansion cycle under constant pressure conditions in engine 70 that fuel in most any proportion and of any oxidizable type can be injected into the cylinder to create a higher pressure and to produce an additional portion of energy. Any form of fuel can be utilized no matter how dirty such fuel might be, since the presence of a sealing mechanism in the engine cylinder wall sealing the piston to the cylinder as described in the previous section of this specification will prevent the leakage of such pollutants or the deleterious effects of any abrasives that may be present in the exhaust or in the fuel itself.

It will also be appreciated that the sealing mechanism described above may also be utilized to pump poisonous gases or materials with pollutants or abrasives in them since the seals will be totally unaffected by the presence of such items. The zero leakage qualities of such a liquid seal will prevent any leakage of poisonous gases and therefore this would be most suitable as a seal for a pump for toxic gaseous materials. Additionally it will be appreciated that if a very close tolerance, mirror-like finish, machining process is performed on the exterior surface of the upper skirt extension 14 that the useful life of an elastomeric seal will be tremendously increased since there will be no opportunity for it to be galled or be abraded by pollutants. Increased life of a seal also produces decreased maintenance and down-time requirements and reduced the cost of maintenance. The greatly reduced machining requirements on this engine being limited primarily to the exterior surface of upper skirt extension 14 make the costs of manufacture of such a system very low indeed.

ELASTOMERIC SEAL AND CYLINDER HEAT SINK

The present invention of an elastomeric seal of conventional construction being useable in a high temperature engine, is better understood by reference to FIG. 3. A cylinder 80 has been bored into a conventional engine block 82, preferably of metal. However, the piston 84, also of metal, is driven from a crankshaft, not shown, via push rod 86 fully through block 82 and into a cylinder extension assembly 90. Cylinder extension assembly 90 is preferably an air cooled heat sink attached to block 82 by a connecting means 92, preferrably a machined socket or bolted connection. Cylinder extension assembly 90 is surrounded, outside of block 82, by an air cooled heat exchanger 94.

It will be noted that cylinder extension assembly 90 bears an internal coating 96, preferrably a high temperature ceramic material as previously described to protect the underlying cylinder extension sleeve 98 which is a closed ended cylinder preferrably of metal. The preferred gap between the exterior surface 100 of piston 84 and the interior surface 102 of cylinder 80 is 0.005 inches, (0.0013 mm), and should be in the range of 0.003 to 0.009 inches, (0.0005 mm to 0.0023 mm). Groove 104 is machined into block 82 perpendicular to the interior wall of cylinder 80 to retain an elastomeric seal 106.

The elastomeric seal 106 is preferably of a conventional and readily available material having resistance to high temperatures as for example Tedlar, Telflon (registered trademarks of E.I. Dupont Co.), or other fluro-carbon and chlorofluoro-carbon polymeric material. Groove 104 is preferrably located a distance A from the face end 110 of piston 84 when the piston is withdrawn the maximum stroke distance from the closed end 112 of cylinder extension assembly 90. The maximum stroke distance B is determined by engine design methods readily understood by those familiar with the art.

Thus the groove is located at a distance A plus B from the closed end of the cylinder. In this way, the elastomeric seal is protected from heat damage even though the temperature of combustion of fuel or high temperature piston driving gas which resides in the chamber between the face end of the piston, and the closed end of the cylinder is substantially higher than the rated temperature of the elastomeric seal. Heat is removed at the air cooled heat sink of the cylinder extension assembly rather than conducted along the piston to the seal. It will be appreciated that without leakage past the pressure seal, convection heat transfer will be minimal or non-existent.

This improved design eliminates the need for piston rings and results in a much more positive pressure seal in a high temperature internal combustion engine. The seal is complete rather than inherently leaking metal piston rings.

Figure 4:
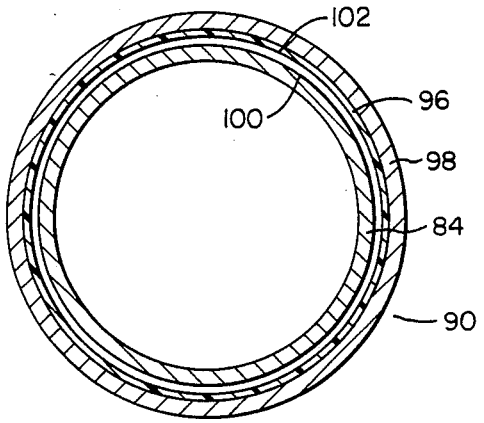
FIG. 4 is a sectional view of the entire piston and cylinder combination of FIG. 3 taken along line 4—4.
Figure 5:
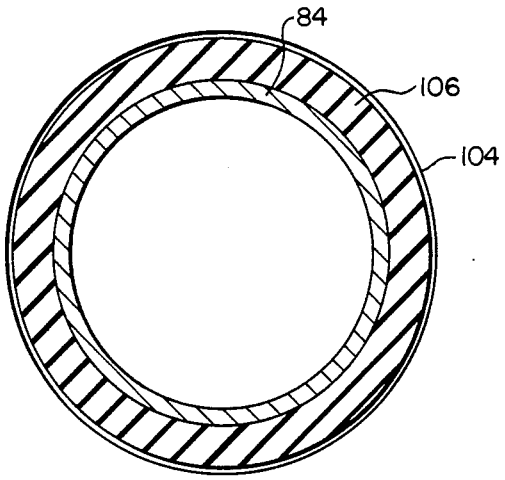
FIG. 5 is a sectional view of the entire piston and cylinder combination of FIG. 3 taken along line 5—5.

Additional understanding of the relationship of the various parts described above in FIG. 3 is achieved by reference to FIG. 4 and 5 which are sectional views of the piston and cylinder combination shown in cut-away in FIG. 3.

FIG. 4 is taken across the cylinder extension assembly 90 which comprises the cylinder extension sleeve 98 and internal temperature resistant coating 96, and further intersects the piston 84. The gap between piston and cylinder is clearly shown here.

FIG. 5 is taken across the elastomeric seal 106 at a level a distance A and B (as shown in FIG. 3) above the closed end of cylinder extension assembly 90.

It will be apparent from the above description that this invention provides a method and apparatus for better sealing a piston to its cylinder, to effectively eliminate efficiency loss due to the leakage of the high temperature, high pressure gas around the edges of the piston. An elastomeric seal is located to make the seal at a minimum sufficient distance from the combustion chamber to prevent heat damage to the seal material by conduction of heat through the piston or cylinder material.

This invention may be embodied in other specific forms without departing from the spirit or essential characteristics thereof. Present embodiments are therefore considered in all respects as illustrative and not restrictive. The scope of the invention being indicated by the appended claims rather than the foregoing description and drawings, and all changes that come within the meaning and range and equivalency of the claims are therefore intended to be embraced therein.

What is claimed is:

1. An apparatus for sealing a cylinder of the type having a closed end and an open end and an interior surface therebetween to a movable piston of the type having a face end and a rod end, said piston being movable over a specific length of said cylinder, comprising: an extension skirt located substantially on the perimeter of the rod end of said piston and extending away from the face end of said piston said skirt extension having an exterior surface in close proximity to the interior surface of said cylinder, an elastomeric pressure seal retained in the interior surface of said cylinder, contacting the exterior surface of said extension skirt at a point spaced apart from the face end of said piston at least a distance adequate to prevent heat at the surface of the piston face end from being excessively transferred by conduction to said pressure seal.

2. An apparatus according to claim 1 wherein said seal is made of a fluoro-carbon material.

3. An apparatus according to claim 1 wherein said cylinder further comprises a heat sink at its closed end for removal of heat residing between said cylinder closed end and said piston face end.

4. An apparatus according to claim 3 wherein said heat sink further comprises a ceramic coating on the interior of the closed end of said cylinder.

5. An apparatus according to claim 3 wherein said heat sink further comprised an air cooled heat exchanger on the exterior of the closed end of said cylinder.

6. A method for sealing a cylinder of the type having a closed end and an open end, to a moveable piston of the type having a face end and a rod end and a skirt said piston being moveable over a specific distance within said cylinder, comprising the steps of:

retaining an elastomeric pressure seal in the interior wall surface of said cylinder, said seal being in pressure retaining contact with said piston at a point on said piston skirt spaced apart from the face end of the piston at least a distance adequate to prevent heat at the surface of the piston face end from being excessively transferred by conduction to said seal.

7. The method according to claim 6 further comprising the step of providing said seal of a fluoro-carbon material.

8. The method according to claim 6 further comprising the step of providing said seal of a material selected from the set consisting of a fluoro-carbon material, a chlorofluoro-carbon material, a fluoro-carbon polymer, a chlorofluoro-carbon polymer, or a material substantially comprising those materials.

9. The method according to claim 6 further comprising the step of providing a heat sink at the closed end of said cylinder for the removal of heat residing between said cylinder closed end and said piston face end.

10. The method according to claim 9 further comprising the step of providing an air cooled heat exchanger on the exterior of the closed end of said cylinder.

11. The method according to claim 6 further comprising the step of providing a heat resistant coating to the interior of the closed end of said cylinder.

12. A method of producing mechanical energy through cyclic changes of a gaseous working fluid, comprising in order the steps of: increasing the temperature and pressure of said working fluid by compression; further increasing the pressure of said working fluid by increasing its temperature at a constant volume condition; extracting energy in a near-isobaric expansion in a cylinder driving a piston; exhausting said working fluid from said cylinder, to the initial pressure of said working fluid.

13. A method according to claim 12 wherein said temperature increase is performed by a counterflow heat exchanger.

14. A method according to claim 12 wherein a portion of said further temperature increase is provided by heat transfer from a secondary heating source.

15. A method according to claim 13 wherein a portion of said further temperature increase is provided by heat transfer from a secondary heating source.

16. A method according to claim 12 wherein said working fluid is derived from an exterior source to the cycle and is exhausted to said same exterior source in an open cycle.

17. A method according to claim 12 wherein the temperature of said working fluid as it enters said cylinder in said energy extracting step is in excess of 2,000° F.

18. The method according to 12 further comprising the steps of providing an apparatus for sealing a cylinder of the type having a closed end and an open end and an interior surface therebetween to a moveable piston of the type having a face end and a rod end, said piston being moveable over a specific length of said cylinder, comprising: an extension skirt located substantially on the perimeter of the rod end of said piston and extending away from the face end of said piston, said skirt extension having an exterior surface in close proximity to the interior surface of said cylinder an elastomeric pressure seal retained in the interior surface of said cylinder, contacting the exterior surface of said extension skirt at a point spaced apart from the face end of said piston at least a distance adequate to prevent heat at the surface of the piston face end from being excessively transferred by conduction to said pressure seal.

* * * * *